US010844655B2

(12) United States Patent
Kindt et al.

(10) Patent No.: US 10,844,655 B2
(45) Date of Patent: Nov. 24, 2020

(54) WATER MANAGEMENT SYSTEM FOR SILL ASSEMBLIES

(71) Applicant: JELD-WEN, Inc., Klamath Falls, OR (US)

(72) Inventors: Derek Kindt, Klamath Falls, OR (US); Jacob Anderson, Klamath Falls, OR (US); Travis Irvine, Klamath Falls, OR (US); Chris Graetsch, Klamath Falls, OR (US); David Yagla, Klamath Falls, OR (US)

(73) Assignee: JELD-WEN, INC., Charlotte, NC (US)

( * ) Notice: Subject to any disclaimer, the term of this patent is extended or adjusted under 35 U.S.C. 154(b) by 0 days.

(21) Appl. No.: 16/714,581

(22) Filed: Dec. 13, 2019

(65) Prior Publication Data

US 2020/0190896 A1 Jun. 18, 2020

Related U.S. Application Data

(60) Provisional application No. 62/780,096, filed on Dec. 14, 2018.

(51) Int. Cl.

| | |
|---|---|
| ***E06B 7/14*** | (2006.01) |
| ***E06B 3/96*** | (2006.01) |
| ***E06B 7/10*** | (2006.01) |
| ***E06B 1/52*** | (2006.01) |

(52) U.S. Cl.

CPC ..... *E06B 7/14* (2013.01); *E06B 1/52* (2013.01); *E06B 3/9632* (2013.01); *E06B 7/10* (2013.01)

(58) Field of Classification Search

CPC . E06B 1/52; E06B 3/9632; E06B 7/10; E06B 7/14

See application file for complete search history.

(56) References Cited

U.S. PATENT DOCUMENTS

| | | | | |
|---|---|---|---|---|
| 3,410,027 | A | 11/1968 | Bates | |
| 4,136,496 | A * | 1/1979 | Molyneux | E06B 3/9641 403/295 |
| 5,067,279 | A | 11/1991 | Hagemeyer | |
| 5,136,814 | A | 8/1992 | Headrick | |
| 5,283,977 | A | 2/1994 | Smith | |
| 5,687,508 | A | 11/1997 | Fitzhenry, Jr. et al. | |
| 6,637,158 | B2 | 10/2003 | Bennett | |

(Continued)

FOREIGN PATENT DOCUMENTS

| | | |
|---|---|---|
| CN | 205259828 U | 5/2016 |
| DE | 102005044944 A1 | 3/2006 |

(Continued)

OTHER PUBLICATIONS

International Search Report and Written Opinion for International Application No. PCT/US2019/066394, dated Feb. 25, 2018, 7 pages.

*Primary Examiner* — James M Ference

(74) *Attorney, Agent, or Firm* — Stoel Rives LLP

(57) ABSTRACT

An assembly for a door or window frame including an elongated sill and a corner key attached to each end of the sill. The corner key includes a water chamber for collecting water therein and a plurality of ports for diverting water from the water chamber outwardly through a drain port. The water chamber and plurality of ports are designed to temper a high-pressure gradient in the sill and effectively promote water egress away from the sill.

15 Claims, 4 Drawing Sheets

(56) References Cited

U.S. PATENT DOCUMENTS

| | | | | |
|---|---|---|---|---|
| 6,763,639 | B2 | 7/2004 | Bennett et al. | |
| 6,789,358 | B2 | 9/2004 | Procton et al. | |
| 6,789,359 | B2 | 9/2004 | Bauman et al. | |
| 7,669,369 | B2 | 3/2010 | Henry et al. | |
| 8,033,056 | B2 | 10/2011 | Wernlund et al. | |
| 8,132,370 | B2 | 3/2012 | Heppner | |
| 8,375,659 | B2 | 2/2013 | Bogenhagen et al. | |
| 8,448,384 | B2 | 5/2013 | Wernlund et al. | |
| 8,499,498 | B2 | 8/2013 | Heppner | |
| 9,388,626 | B2 | 7/2016 | Gilbert et al. | |
| 9,487,992 | B2 | 11/2016 | Meeks | |
| 9,863,183 | B2 | 1/2018 | Johnson et al. | |
| 10,060,178 | B2 | 8/2018 | Seiling | |
| 2002/0112421 | A1* | 8/2002 | Bennett | E06B 3/9632 52/204.1 |
| 2005/0115178 | A1* | 6/2005 | Schmidt | E06B 3/9641 52/272 |
| 2005/0198911 | A1 | 9/2005 | Baczuk et al. | |
| 2006/0096190 | A1* | 5/2006 | Baczuk | E06B 3/9632 52/204.1 |
| 2006/0150521 | A1* | 7/2006 | Henry | E06B 1/70 49/471 |
| 2010/0162644 | A1* | 7/2010 | Campbell | E06B 1/70 52/209 |
| 2010/0325982 | A1* | 12/2010 | Bogenhagen | E06B 7/2316 52/211 |
| 2014/0041326 | A1* | 2/2014 | Kadavy | E06B 7/14 52/209 |
| 2015/0096235 | A1 | 4/2015 | Rochman | |
| 2016/0053529 | A1* | 2/2016 | Pettibone | E06B 7/14 52/209 |
| 2016/0273260 | A1 | 9/2016 | Jolie et al. | |
| 2017/0058592 | A1 | 3/2017 | Meeks | |
| 2017/0234060 | A1* | 8/2017 | Graetsch | E06B 1/18 49/471 |
| 2017/0298676 | A1 | 10/2017 | Wilhelf et al. | |
| 2020/0190896 | A1* | 6/2020 | Kindt | E06B 3/9632 |

FOREIGN PATENT DOCUMENTS

| | | | |
|---|---|---|---|
| EP | 2246513 | B1 | 1/2016 |
| GB | 2378975 | | 2/2003 |
| JP | 2002250066 | A | 9/2002 |
| WO | 2006076496 | A2 | 7/2006 |
| WO | 2009086510 | A1 | 7/2009 |
| WO | 2010077236 | A1 | 7/2010 |

* cited by examiner

WATER MANAGEMENT SYSTEM FOR SILL ASSEMBLIES

RELATED APPLICATION DATA

This application is a nonprovisional of and claims the benefit under 35 U.S.C. § 119(e) of U.S. Provisional Patent Application No. 62/780,096, filed Dec. 14, 2018, the disclosure of which is incorporated by reference herein in its entirety.

TECHNICAL FIELD

The field of this disclosure relates generally to sill assemblies for doors and windows, and in particular, to such sill assemblies with water management features for diverting water away from the sill assembly in an effort to prevent water intrusion into the interior of the building or dwelling.

BACKGROUND

Conventional door systems, such as patio doors, typically include a sill assembly located along the lower portion of the door frame, where the sill assembly provides a transition between the exterior environment and the interior region of a building or dwelling. In some designs, sill assemblies help serve as a weather-proofing barrier for the doorway, where the sill assembly diverts water away from the door and interior of the building to avoid mildew, rot, or other water damage. Many conventional sill assembly designs can adequately handle minimal water and wind loads to minimize or restrict water intrusion. Some sill assemblies are designed with various drainage pathways to help resist water ingress from wind-driven rain and high differential pressures of the kind experienced in many coastal areas during tropical storms, typhoons, and hurricanes. However, many such designs are complex and do not provide optimal performance for extreme weather conditions. In addition, other conventional designs fail to provide proper mechanisms to promote efficient water drainage, thereby resulting in water build-up and eventual water intrusion into the house or building.

Accordingly, the present inventors have identified a need for a sill assembly design incorporating a water management system to improve drainage and effectively divert water away from the sill assembly and doorway. The present inventors have also identified a need for such a sill assembly designed to restrict or fully eliminate water intrusion during severe storms that tend to bring large volumes of wind-driven rain. In addition, the present inventors have also identified a need for such a sill assembly having a streamlined design to minimize manufacturing costs and simplify installation. Additional aspects and advantages will be apparent from the following detailed description of example embodiments, which proceeds with reference to the accompanying drawings.

DETAILED DESCRIPTION OF EXAMPLE EMBODIMENTS

With reference to the drawings, this section describes embodiments of a sill assembly and its detailed construction and operation. Throughout the specification, reference to "one embodiment," "an embodiment," or "some embodiments" means that a particular described feature, structure, or characteristic may be included in at least one embodiment of the sill assembly. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 1:
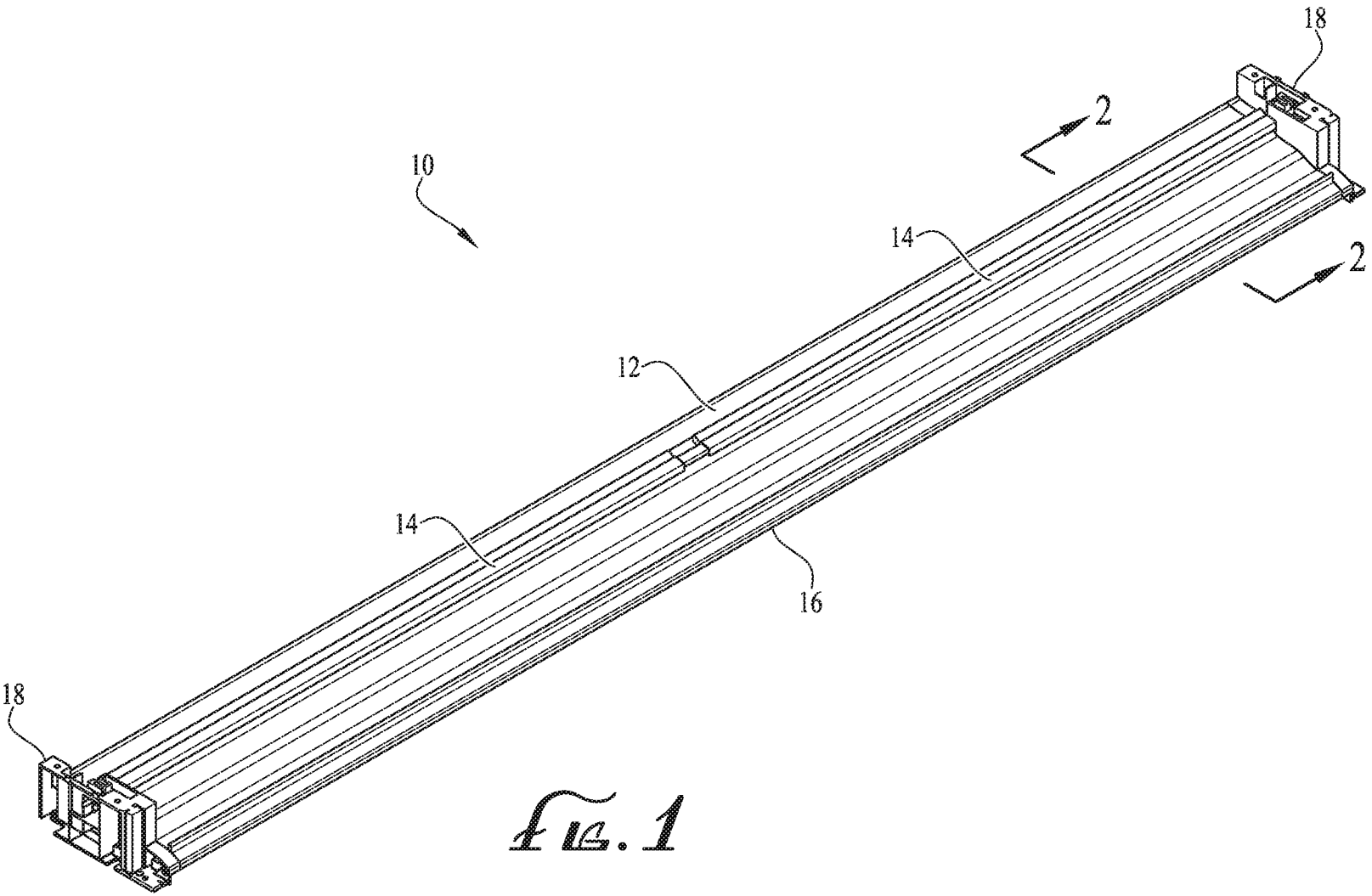
FIG. 1 is a perspective view of a sill assembly including a sill and a pair of corner keys for a fenestration opening in accordance with an example embodiment.

FIGS. 1-6 collectively illustrate embodiments of a water management system for an assembly 10 that may be used for any suitable fenestration system, such as patio doors, for a building or dwelling. The assembly 10 includes a sill 12 and a pair of corner keys 18, each corner key 18 being coupled to or affixed to an end of the sill 12 as shown in FIG. 1. In a completed fenestration frame assembly (not shown), each corner key 18 is also coupled to and supports an upright jamb member (not shown). As further discussed in detail below, the assembly 10 is designed for diverting water away from an interior of a building or doorway.

During extreme weather events, the exterior of the assembly 10 is subjected to air pressure and water concentrations. As these conditions continue for prolonged periods of time, a substantial pressure differential is created between the exterior environment (high pressure region) and interior environment (low pressure region) surrounding the assembly 10. This pressure differential may result in water being forced through the assembly 10, such as through small openings or seams at various adjoining surfaces, and into the building or dwelling regardless of the presence of sealing structures or weatherstrips on the assembly 10 designed to restrict such water flow. Because sill systems are not effective at completely sealing all water out, especially during severe storms, a water management system is employed to handle any water that has entered the assembly 10 and allow it to drain away and back to the exterior environment.

The following passages provide a brief description of various features of the overall system, followed by a more thorough description of each component and their interoperability to achieve the water management features described above. As further detailed below with reference to the figures, the water management features for the overall door system are primarily built into the corner keys 18 for managing internal/external pressure differentials to maximize water performance of the overall assembly 10 without requiring complex weep designs integrated into the sill or stepped joinery at the jamb-sill intersection of the fenestration structure. Accordingly, this versatility allows for easier installation and simplifies jamb and sill-end work.

Briefly, the water management system described herein is designed to store a column of water 48 in a rear reservoir or sill water chamber 32, where the water 48 builds static head pressure as it accumulates in the water chamber 32. The water management system then uses this static head pressure built by the column of water 48 to overcome the pressure differential across the sill assembly 10 and drive water out of the assembly 10. Depending on the amount of static head pressure built in the water chamber 32, some water may be driven out of the assembly 10 even as water continues flowing in.

Figure 2:
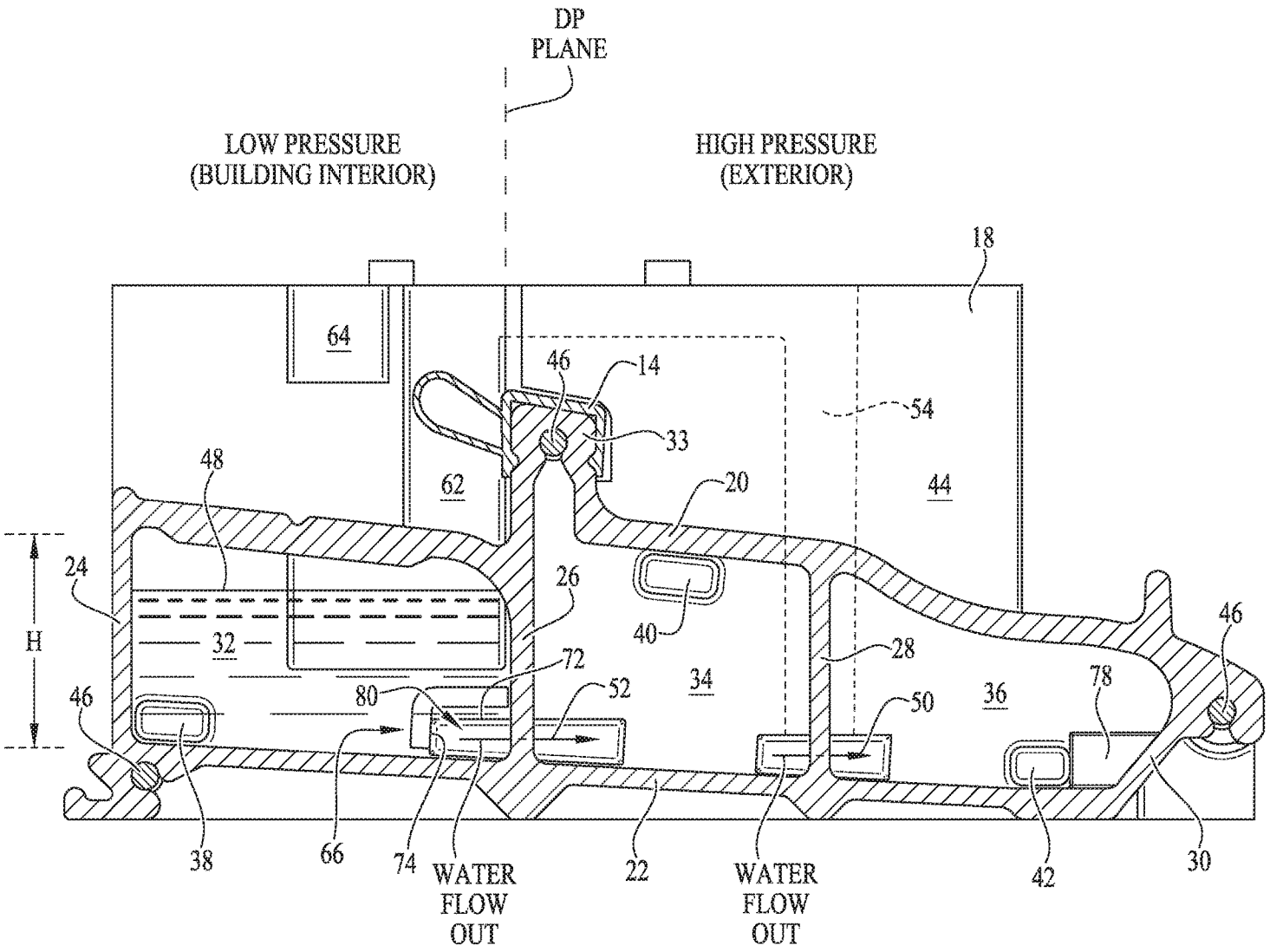
FIG. 2 is a cross-sectional detail view of the sill assembly cut along sectioning lines 2-2 of FIG. 1 illustrating details of a mated sill and corner key configuration.

Briefly, with reference to FIG. 2, the corner key 18 includes a first key port 52 and a second key port 50, where the first key port 52 has a size and dimension equal to or larger than the second key port 50 to promote an adequate water flow rate between the sill chambers 32, 34, 36 and drive water outwardly toward the exterior environment. The corner key 18 further includes a chimney vent 54 in communication with the second key port 50 (see FIGS. 3 and 4), where the chimney vent 54 is designed to help relieve the pressure in the sill chambers 34, 36, thereby reducing the overall pressure differential and allowing for higher water flow rate out of the sill 12. In addition, the corner key 18 further includes a series of baffles 76 positioned along the pressure gradient reduction passageway that together with the side walls of the chimney vent 54 operate to help collect any water droplets carried by the air moving through the chimney vent 54, thereby minimizing potential infiltration of water droplets into the dwelling interior. Once collected by the side walls of the chimney vent 54 of the baffles 76, the water droplets may be redirected back toward the water chamber 32 or to the sill chambers 34, 36 for removal from the sill 12.

Figure 3:
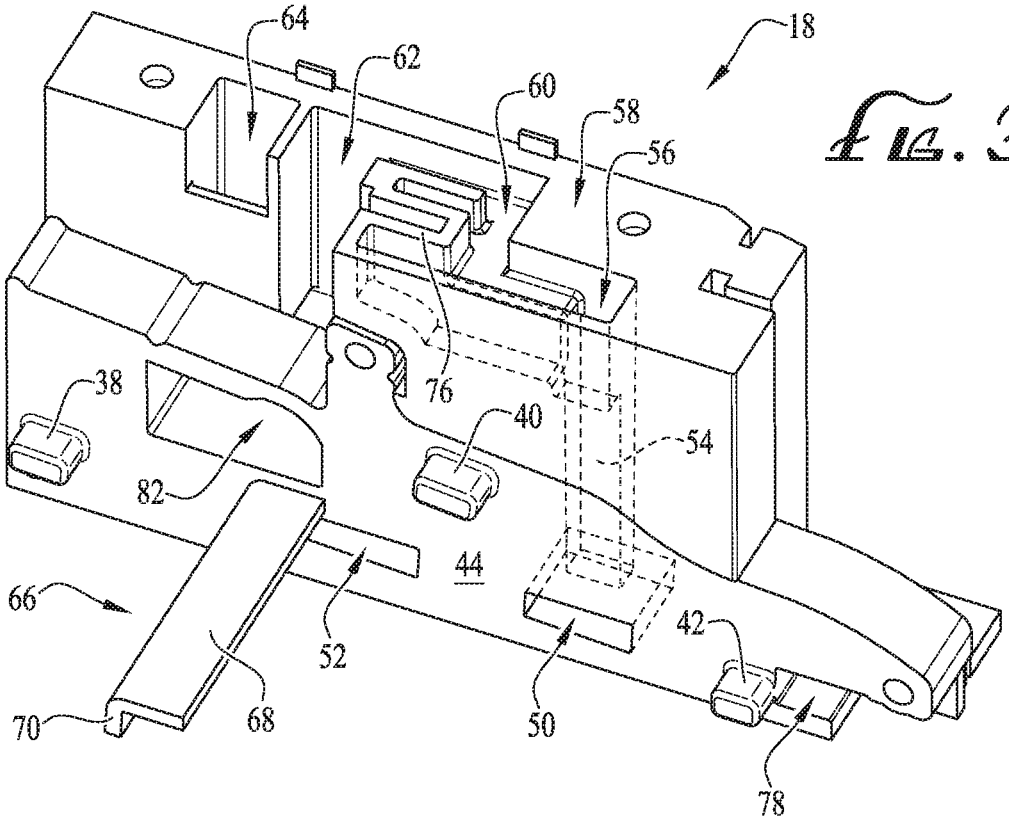
FIGS. 3 and 4 are perspective views of the corner keys of FIG. 1 in accordance with one embodiment.
Figure 4:
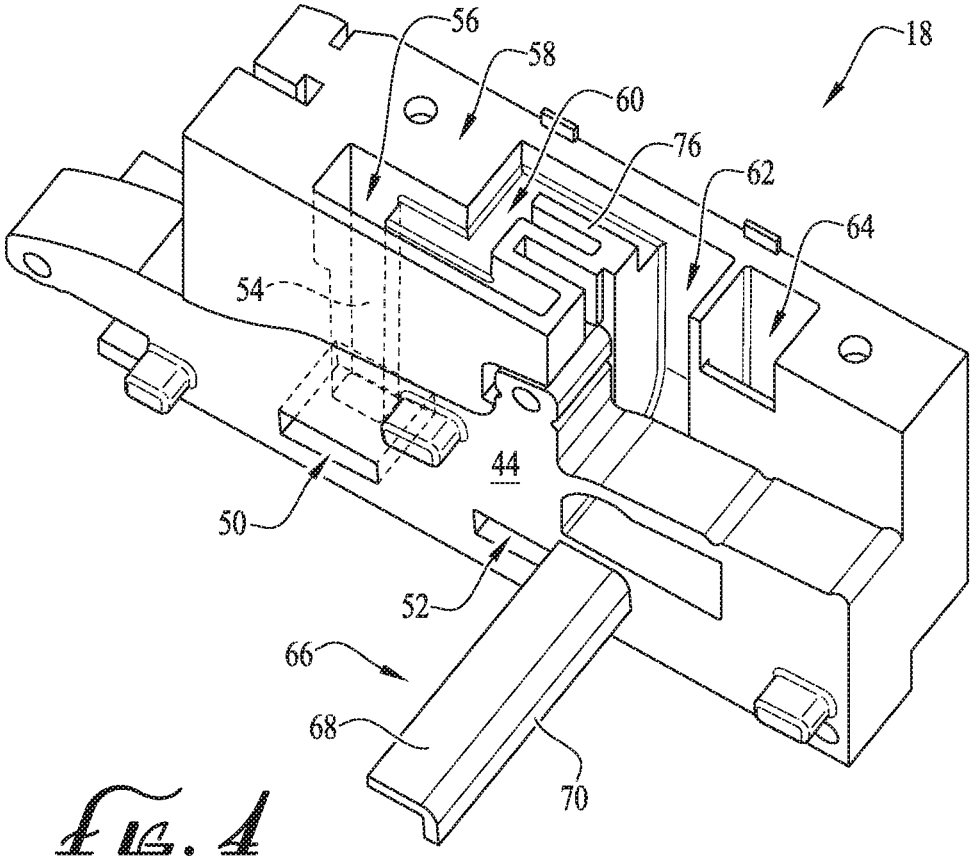
Figure 5:
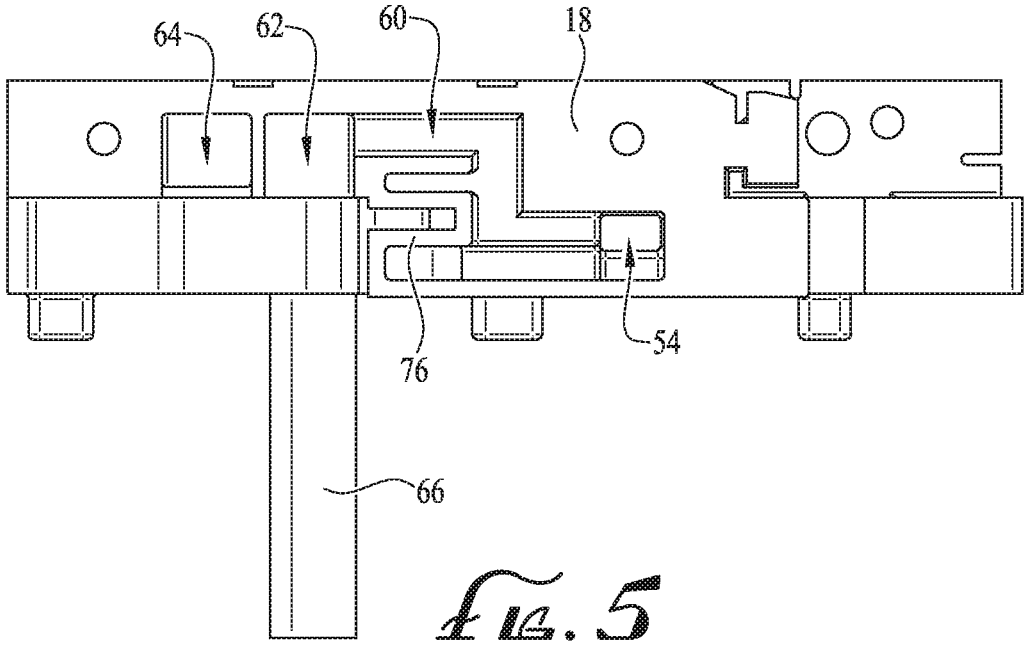
FIG. 5 is a top view of the corner key of FIG. 1 in accordance with one embodiment.

Finally, the corner key 18 includes a degassing arm 66 extending outwardly therefrom and into the water chamber 32 of the sill 12. With reference to FIGS. 2-4, the degassing arm 66 extends over and covers an upper portion 72 and side portion 74 of the first key port 52 to help divert water and air that is moving rearwardly through the first key port 52 and keep it away from the interior of the dwelling. As further detailed below, the degassing arm 66 is designed to manage air ingress and provide additional time for any froth collected at the top of the water chamber 32 to stabilize, thereby reducing droplet concentration and minimizing droplets from being projected into the interior of the building or doorway. Additional details of each of these components and their interoperation in the assembly 10 are described in further detail below with reference to the figures.

FIG. 1 illustrates an assembly 10 for use in an entryway, such as for patio doors, of a building or dwelling. The assembly 10 includes an elongated sill 12 made of any one of a variety of materials, such as polyvinyl chloride (PVC), pultruded fiberglass, aluminum or any other suitable materials. The sill 12 includes a seal or weatherstrip 14 extending across some or the entirety of the sill 12, with the sill 12 sloping generally downwardly from the weatherstrip 14 to a forward edge 16 to help direct water and debris away from the interior of the dwelling. In some embodiments, the seal 14 may be a single unitary structure, but in other embodiments the seal 14 may include two or more structures extending across the sill 12. Corner keys 18 are coupled to opposite ends of the elongated sill 12, with the corner keys 18 essentially serving as end caps for the sill 12 and supporting a door jamb (not shown) when assembled into a completed framing structure as noted previously. The corner keys 18 are preferably manufactured as a single, integral structure and may be made of any suitable material, such as an injection molded plastic material.

FIG. 2 is a cross-sectional view of the assembly 10 cut along sectioning lines 2-2 of FIG. 1 illustrating details of a mated sill and corner key configuration. With reference to FIG. 2, the following describes details for securing the corner keys 18 to the sill 12 in accordance with one embodiment. As illustrated in FIG. 2, the sill 12 includes a first elongated frame member 20 and a second elongated member 22, each of which extending along a generally horizontal axis and offset from one another. The sill 12 also includes a plurality of vertical legs 24, 26, 28, 30 extending between the frame members 20, 22, where the legs 24, 26, 28, 30 collectively support the frame members 20, 22 to form an overall profile of the sill 12. As illustrated, in one embodiment, the frame members 20, 22 and the legs 24, 26, 28, 30 are arranged to define three distinct hollow chambers 32, 34, 36 of the sill 12, where the chambers 32, 34, 36 each extend along some or the entire length of the sill 12 between the corner keys 18. The sill 12 further includes a seal housing 33 formed along the first frame member 20, the seal housing 33 designed to secure a seal 14 that extends upwardly therefrom and across the sill 12 between the corner keys 18 (see FIG. 1) to help divert water and debris away from the interior of the building. Additional details of the chambers 32, 34, 36 and their functionality are described further with particular reference to FIGS. 3-5.

Returning to FIG. 2, the corner key 18 includes a plurality of mounts 38, 40, 42 formed thereon as integral components of the corner key 18, where each of the mounts 38, 40, 42 protrudes or extends outwardly from a sill-facing side surface 44 of the corner key 18 (see also FIG. 3). When the corner key 18 is coupled to the sill 12, the mounts 38, 40, 42 sit against and engage various regions of the sill 12 to help support and stabilize the corner key 18 in position against the sill 12. For example, with reference to FIG. 2, mount 38 rests at the rear junction of the bottom frame member 22 and rear leg 24 of the sill 12 and extends into the rear chamber 32. Similarly, mount 40 supports the top frame member 20 along a mid-portion thereof and extends into the middle chamber 34 of the sill 12, and mount 42 sits against the bottom frame member 22 adjacent the front leg 30 and extends into the front chamber 36. Once the corner key 18 is in position, a plurality of fasteners 46 are used to securely mount the corner key 18 to the sill 12 at various attachment points as illustrated.

It should be understood that the particular arrangement of the interior profile of the sill 12 illustrated in FIG. 2, and the location of the mounts 38, 40, 42, is for illustration purposes only and not intended to be limiting. One having ordinary skill in the art may make changes to the sill profile and the corner key 18 without departing from the principles of the disclosed subject matter.

Figure 6:
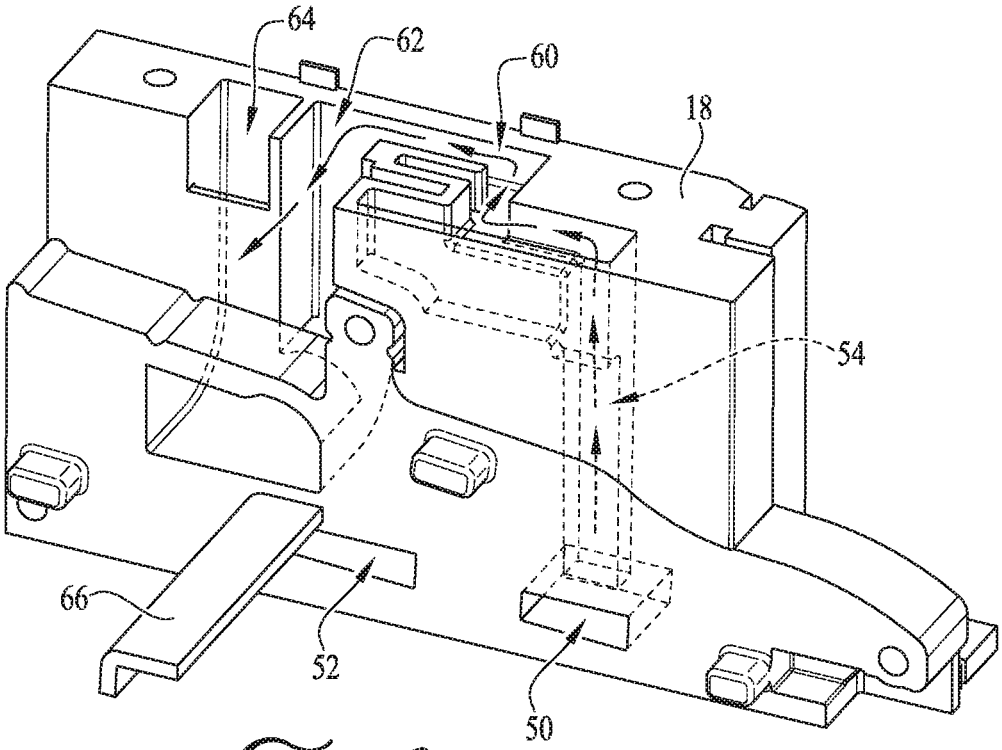
FIG. 6 is a view of the corner key of FIG. 1 illustrating a pressure gradient reduction passage for improving the water egress rate in accordance with one embodiment.

With reference to FIGS. 2-5, the following provides details of the water management features of the assembly 10, followed by a discussion with reference to FIG. 6 of how the components of the corner key 18 operate in conjunction with the features of the sill 12 for managing water ingress.

Turning to FIG. 2, the rear chamber 32 is essentially a water chamber designed to collect and store water 48 entering the sill 12 (e.g., via wind-driven rain or a storm event). As the water 48 collects in the water chamber 32, it builds head pressure to help equalize and overbalance the pressure differential created by the storm that tends to draw water into the sill 12, thereby minimizing water intrusion into the dwelling. Accordingly, the water chamber 32 plays a key role in managing the overall performance of the sill 12, as the selected height of the water chamber 32 determines how much head pressure can be accumulated. If the water chamber 32 is not sufficiently tall, then the water column in the water chamber 32 may not build sufficient head pressure to overcome the air pressure differentials created by the storm event, at which point the water chamber 32 will overflow and allow water 48 to infiltrate the interior of the sill 12 and the building. Accordingly, the height H of the water chamber 32 is preferably selected to allow for water build-up and head pressure to overcome air pressure differentials in a given region. In some embodiments, local weather data may be used to determine anticipated air pressure differentials to calculate an appropriate height for the water chamber 32 to ensure that the water will build sufficient head pressure to avoid water intrusion into the interior of the building or dwelling.

In some embodiments, the height H of the water chamber may be designed for specific performance grade (PG) or design pressure (DP) ratings of the door. Generally speaking, the higher the PG or DP rating, the taller the water chamber 32 should be to allow for building of sufficient head pressure in the water chamber 32 to avoid overflow. For example, in some embodiments, the height of the water chamber 32 may range between 0.50 inches to 2.80 inches for DP ratings of 20 to 70, with the height of the water chamber 32 increasing as the DP rating increases.

FIGS. 3 and 4 collectively illustrate perspective views of the corner key 18. With reference to FIGS. 3 and 4, the corner key 18 includes a first key port 52 and a second key port 50 offset from one another, each of the ports 50, 52 recessed into a lower portion of the sill-facing side surface 44 of the corner key 18. In some embodiments, the ports 50, 52 may be aligned with one another relative to a horizontal axis such that the horizontal axis crosses both of their respective midpoints. In other embodiments, the ports 50, 52 may be slightly offset from the horizontal axis such that the axis still crosses both ports 50, 52, but not at their respective midpoints. In operation, the ports 50, 52 collectively function as passageways to allow water 48 to travel between the sill chambers 32, 34, 36 and out of the assembly 10 (see FIG. 2) as further described in detail below. In some instances, water 48 may be driven rearwardly through the ports 50, 52 as well, such as when a high-pressure gradient exists on the exterior of the assembly 10. Features for minimizing the impact of rearwardly travelling water and air are discussed in detail below with reference to FIG. 6.

Returning to FIGS. 3-4, to promote adequate flow of water 48 through the key ports 50, 52 and allow water to exit the assembly 10, the width, height, and depth dimensions of the respective ports 50, 52 are selected to provide a sufficiently large pathway as desired. For example, the key ports 50, 52 may be designed such that the water passageway of the respective ports 50, 52 accommodates water flow at an equal flow rate through each of the key ports 50, 52. In other embodiments, the first key port 52 may have a larger passageway (e.g., a passageway with a larger diameter and larger cross-sectional area) as compared to that of the second key port 50, wherein water flows at a higher rate through the first key port 52 as compared to the second key port 50. Preferably, the first key port 52 is not smaller (e.g., has a passageway with a smaller cross-sectional area) as compared to the second key port 50 to avoid having an insufficient water flow between the key ports 50, 52 or having the first key port 52 become a bottleneck point that detrimentally impacts sill performance due to it having a slower flower rate than the second key port 50.

For example, in some embodiments, as noted previously, the key ports 50, 52 may have a substantially equal cross-sectional area such that water flows at an equal rate through the ports 50, 52. In other embodiments, the cross-sectional area of the first key port 52 may be up to three times larger than the cross-sectional area of the second key port 50 to promote a higher water flow rate at the first key port 52 as compared to the second key port 50. In some embodiments, the key port 52 may have a height of 0.200 inches±0.125 inches (as measured from a mid-point of the key port 52), a width of 1.00 inches±0.50 inches, and recessed at a depth into the sill-facing surface 44 of 0.600 inches±0.250 inches. Key port 50 may have a height of 0.200 inches±0.125 inches (measured at a mid-point of the key port 52), a width of 0.680 inches±0.50 inches, and recessed at a depth into the sill-facing surface 44 of 0.600 inches±0.250 inches. As noted previously, additional details regarding an example water flow path between the key ports 50, 52 is provided below with reference to FIG. 6.

With reference to FIG. 3, the corner key 18 further includes a chimney vent 54 formed on an interior region of the corner key 18 inward of the sill-facing side surface 44, where the chimney vent 54 includes a first opening (not shown) in communication with the second key port 50 and a second opening 56 formed along an upper jamb-facing surface 58 of the corner key 18, where the upper jamb-facing surface 58 is generally orthogonal to the sill-facing surface 44 and is coupled to a jamb (not shown) of the door or window structure in a completed assembly. The chimney vent 54 preferably extends to a sufficient height above the second key port 50 to help produce a desired pressure gradient reduction in the sill chambers 34, 36, and to collect any water droplets carried by the air moving within the assembly 10 as further described in detail below with reference to FIG. 2. In some embodiments, the chimney vent 54 may extend to a height of at least 0.25 inches above the second key port 50. In other embodiments, the chimney vent 54 may range in height between 0.25 inches and 5 inches. In still other embodiments, the chimney vent 54 may extend along the entire interior of the jamb (not shown), and so the chimney vent 54 may have a height equal to the entire height of the jamb.

The upper jamb-facing surface 58 of the corner key 18 further includes an air channel 60 formed thereon, the air channel 60 being in communication with the chimney vent 54 and the opening 56. The air channel 60 is further in communication with a passageway 62 along the upper jamb-facing surface 58 and having an opening 82 on the sill-facing surface 44 of the corner key 18. When the corner key 18 is mated with the sill 12, the passageway 62 opens into the water chamber 32 of the sill 12 (see FIG. 2). The passageway 62 also communicates with a rear vent 64 formed adjacent a rear portion of the corner key 18 and along the upper jamb-facing surface 58 to help stabilize the pressure gradient as needed. Preferably, the cross-sectional area of the opening of the passageway 62 (see FIG. 5) is at least ⅛ larger than the corresponding cross-sectional area of the opening of the second key port 50 (as illustrated in FIG. 2). As further described in detail below with reference to FIG. 6, the chimney vent 54, air channel 60, passageway 62, and rear vent 64 work together to provide a collective pathway that helps reduce the pressure gradient in the sill chambers 34, 36, thereby allowing water to exit the sill chambers 34, 36, and ultimately exit the assembly 10. The components also work together to create a circuitous path with various walls and hard surfaces designed to help collect any water droplets from the air flowing through the corner key 18 and sill 12 to minimize water infiltration into the building.

With reference to FIG. 3, the corner key 18 further includes a degassing arm 66 extending outwardly from the sill-facing side surface 44. The degassing arm 66 may be generally L-shaped, with a horizontal leg 68 and a vertical leg 70 arranged generally orthogonally to one another. The degassing arm 66 is positioned adjacent the first key port 52 of the corner key 18, with the horizontal leg 68 extending over an upper portion 72 of the first key port 52 and the vertical leg 70 positioned behind a side portion 74 of the first key port 52 (see FIG. 2). With particular reference to FIG. 2, when the corner key 18 is assembled with the sill 12, the horizontal leg 68 abuts against the vertical support leg 26 of the sill 12 to substantially seal off an upper pathway above the first key port 52 from any incoming water or air. In some embodiments, the vertical leg 70 may block most of the side portion 74 of the key port 52, where the vertical leg 70 is offset from the frame member 22 by a small gap to provide a narrow passageway for water 48 to continue moving outwardly of the water chamber 32 toward the chamber 34 when the pressure differentials are favorable. Preferably, the passageway is sufficiently small to minimize water or air intrusion from flowing back into the water chamber 32.

As described previously, the degassing arm 66 serves to block or impede much of the water 48 and air moving rearwardly from the second sill chamber 34 toward the water chamber 32 through the first key port 52, while still accommodating flow of the water 48 outwardly from the water chamber 32 when appropriate. While some water and air may penetrate into the water chamber 32 underneath the vertical leg 70, the length of the degassing arm 66 nonetheless serves to increase the overall distance (and therefore time) that the incoming water/air mixture must travel as it exits the first key port 52 before it can infiltrate the interior of the dwelling. Diverting the water and air also provides additional time for outgassing the water/air mixture while the mixture is contained within the sill 12 and corner key 18. This outgassing process may help prevent or minimize infiltration of water droplets through the sill 12 and into the interior of the building or dwelling.

The length of the degassing arm 66 extending outwardly from the sill-facing side surface 44 of the corner key 18 may vary depending on the features and characteristics of the corner key 18. Preferably, the length of the degassing arm 66 is greater than the height of the shorter of the two key ports 50, 52 (as measured from their respective bottom surfaces to their top surfaces). In some embodiments, the cross-sectional area of a cavity 80 (see FIG. 2) bounded between the legs 68, 70 of the degassing arm 66, the frame member 22 of the sill 12, and the vertical support leg 26 of the sill 12 is preferably at least equal to or greater than ⅛ of the cross-sectional area of the first key port 52.

With particular reference to FIGS. 2 and 6, the following provides details of the water management features of the assembly 10 for preventing water from entering into the building or dwelling. As noted previously, the assembly 10 functions as a self-draining system for an exterior door of a building or dwelling. When minimal water enters the sill 12, the overall slanted profile of the sill 12 is capable of directing the water outwardly to the exterior environment and away from the interior portion of the building. If the water 48 penetrates entirely through to the rear of the sill 12, the water accumulates in the water chamber 48. Under normal conditions (e.g., no substantive differential pressure between the interior and exterior portions of the sill assembly 10), the accumulated water 48 is directed toward the front of the water chamber 48 adjacent the support leg 26 of the sill 12 (see FIG. 2). The water 48 is then directed toward the first key port 52, whereat the water travels within the passageway of the first key port 52, around the support leg 26 of the sill 12, and into the sill chamber 34. From the sill chamber 34, the water moves toward the support leg 28 of the sill 12, whereat the water travels within the passageway of the second key port 50 and around the support leg 28, and into the sill chamber 36. Thereafter, the water exits from the sill chamber 36 into the exterior environment via a drain port 78. In some embodiments, the drain port 78 has a height that is less than the combined height of the key ports 50, 52.

Under extreme weather conditions, however, wind-driven rain against the exterior portion of the sill 12, may allow water to permeate through the seal 14 or other imperfect seals, such as at the junction of the sill 12 and the corner keys 18, and enter the sill 12 at an accelerated rate. Moreover, wind forces exerted on the exterior of the sill 12 cause an air pressure differential across the assembly 10, with higher air pressure exerted on the exterior of the building than on the interior of the building. This pressure differential causes water to move even more rapidly from the exterior to the interior of the building. This water movement continues until the pressure is equalized between the interior and exterior of the building. During these pressure conditions, water 48 cannot effectively drain naturally, and so it accumulates within the sill 12.

Turning now to FIG. 2, the incoming water 48 accumulates in the water chamber 32 at the rear portion of the sill 12. Over time, the water level in the water chamber 32 rises as water continues moving into the sill 12 due to wind and increasing pressure differentials. As the water column rises in the water chamber 32, it builds a head pressure that serves to counter the high-pressure areas building in the sill chambers 34, 36. As described previously, the chimney vent 54 serves to temper the high-pressure gradient in the sill chambers 34, 36 by directing air flow upwardly through the second key port 50 and into the upper jamb-facing surface 58 of the corner key 18, whereat the air flows through the channel 60, the passageway 62, and through the rear vent 64 (see FIG. 6). This process helps reduce the pressure gradient by connecting the high-pressure regions of the sill 12 to regions with lower pressure, thereby allowing the pressure differential within the sill 12 to quickly stabilize.

As the air flows through the pathway, any droplets of water that it may be carrying are trapped and collected either by the walls of the chimney vent 54 or a series of baffles 76 positioned within the channel 60 (or other sections of the pathway), thereby minimizing droplet infiltration into the interior of the dwelling. To further minimize droplet infiltration, any air or water being forced rearwardly through the key ports 50, 52 is initially obstructed by the degassing arm 66 formed adjacent the first key port 52 to provide additional time for outgassing of the water/air mixture being driven through the sill 12.

As the water 48 continues to rise in the water chamber 32, the water column builds head pressure in the water chamber 32 to help equalize, and eventually overbalance the pressure gradient in the sill 12. Over time, the water column produces head pressure to overcome the air pressure differential between the interior and exterior portions of the assembly 10 and reverse the inward migration of water. As the water 48 accumulates in the water chamber 32, the chimney vent 54, channel 60, the passageway 62 and rear vent 64 collectively operate to reduce the pressure gradient in the sill chambers 32, 34 to help ensure that the water 48 can be expelled before the water chamber 32 overfills and moves into the interior of the building or dwelling.

It is intended that subject matter disclosed in particular portions herein can be combined with the subject matter of one or more of other portions herein as long as such combinations are not mutually exclusive or inoperable. In addition, many variations, enhancements and modifications of the lighted shelf assembly concepts described herein are possible.

The terms and descriptions used above are set forth by way of illustration only and are not meant as limitations. Those skilled in the art will recognize that many variations can be made to the details of the above-described embodiments without departing from the underlying principles of the invention.

The invention claimed is:

1. An assembly for a door or window frame, comprising:
an elongated sill having a first end and an opposite second end, the sill including a first chamber, a second chamber, and a third chamber, the first chamber operable for collecting and storing water entering the sill; and
a corner key having a sill-facing surface, the corner key coupled to the sill along the sill-facing surface, the corner key comprising:
a first port formed along the sill-facing surface, the first port defining a first passage between the first and second chambers of the sill for allowing water to flow from the first chamber to the second chamber;
a second port formed along the sill-facing surface and offset from the first port, the second port defining a second passage between the second chamber and the third chamber of the sill for allowing water to flow from the second chamber to the third chamber; and
a drain in communication with the third chamber and operable to direct water from the third chamber out of the corner key.

2. The assembly of claim 1, the corner key further including a chimney vent in communication with the second port, the chimney vent operable to divert air and water ingress away from the third chamber.

3. The assembly of claim 2, the corner key further including a jamb-facing surface, the chimney vent having an opening formed along the jamb-facing surface.

4. The assembly of claim 3, the corner key further including a channel formed on the jamb-facing surface, the channel being in communication with the chimney vent, the channel further including a series of baffles for collecting water moving through the chimney vent and channel.

5. The assembly of claim 4, the corner key further including a passageway having a first opening along the jamb-facing surface and a second opening on the sill-facing surface of the corner key, the passageway being in communication with the channel via the first opening and the first chamber via the second opening to direct water present in the chimney vent to the first chamber.

6. The assembly of claim 5, the corner key further including a rear vent in communication with the passageway, the rear vent operable to divert air ingress away from the first chamber.

7. The assembly of claim 2, the corner key further including a jamb-facing surface and a passageway having a first opening along the jamb-facing surface and a second opening on the sill-facing surface of the corner key, the passageway being in communication with the chimney vent via the first opening and the first chamber via the second opening to direct water present in the chimney vent to the first chamber.

8. The assembly of claim 7, the corner key further including a rear vent in communication with the passageway, the rear vent operable to divert air ingress away from the first chamber.

9. The assembly of claim 1, wherein a first flow rate of water through the first port is at least equal to a second flow rate of water through the second port.

10. The assembly of claim 1, wherein the elongated sill includes a first leg separating the first and second chambers from one another, and a second leg separating the second and third chambers from one another, and wherein the first leg is adjacent the first port and the second leg is adjacent the second port.

11. The assembly of claim 10, wherein the first leg and first port together define a first passageway for water flowing between the first and second chambers, and wherein the second leg and second port together define a second passageway for water flowing between the second and third chambers.

12. The assembly of claim 11, wherein water moving between the first and second chambers moves into a portion of the first port in the first chamber, around the first leg and into the first passageway, and into a portion of the first port in the second chamber.

13. The assembly of claim 1, the corner key further comprising an arm extending outwardly from the sill-facing surface and into the first chamber of the elongated sill body, the arm including a first leg and a second leg arranged in a generally orthogonal configuration.

14. The assembly of claim 13, wherein the first leg of the arm extends above a first portion of the first port, and wherein the second leg of the arm is positioned adjacent a second portion of the first port, the first and second legs impeding a flow of water and air moving from the second chamber into the first chamber via the first port.

15. The assembly of claim 1, further comprising a plurality of mounts formed along the sill-facing surface of the corner key, each of the mounts extending outwardly therefrom and coupling with one or more legs of the sill to support the sill and corner key in a mated configuration.

* * * * *